US007929893B2

(12) United States Patent
Takahashi et al.

(10) Patent No.: US 7,929,893 B2
(45) Date of Patent: Apr. 19, 2011

(54) IMAGE FORMING APPARATUS COMPRISING AN INTERMEDIATE TRANSFER BELT

(75) Inventors: Masashi Takahashi, Kanagawa-ken (JP); Minoru Yoshida, Tokyo (JP); Takeshi Watanabe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 961 days.

(21) Appl. No.: 11/621,808

(22) Filed: Jan. 10, 2007

(65) Prior Publication Data

US 2008/0166158 A1 Jul. 10, 2008

(51) Int. Cl.
*G03G 15/16* (2006.01)

(52) U.S. Cl. ..... 399/302; 399/308

(58) Field of Classification Search ..... 399/302, 399/308, 303, 313

See application file for complete search history.

(56) References Cited

U.S. PATENT DOCUMENTS

| | | | | |
|---|---|---|---|---|
| 5,394,226 | A * | 2/1995 | Beardsley et al. | 399/308 |
| 5,410,390 | A * | 4/1995 | Miura et al. | 399/303 |
| 5,572,304 | A * | 11/1996 | Seto et al. | 399/313 |
| 5,666,193 | A * | 9/1997 | Rimai et al. | 399/308 |
| 5,701,568 | A * | 12/1997 | Hiroshima et al. | 399/302 |
| 5,740,508 | A * | 4/1998 | Matsuura et al. | 399/308 |
| 5,899,610 | A * | 5/1999 | Enomoto et al. | 399/302 |
| 6,205,301 | B1 * | 3/2001 | Shigeta et al. | 399/308 |
| 2001/0016130 | A1 * | 8/2001 | Bessho et al. | |
| 2003/0007810 | A1 * | 1/2003 | Enomoto et al. | 399/302 |

FOREIGN PATENT DOCUMENTS

| | | |
|---|---|---|
| JP | 60-214377 | 10/1985 |
| JP | 64-050089 | 2/1989 |
| JP | 05-061383 | 3/1993 |
| JP | 05-341643 | 12/1993 |
| JP | 06-075484 | 3/1994 |
| JP | 06-110343 | 4/1994 |
| JP | 09-062057 | 3/1997 |
| JP | 11-249452 | 9/1999 |
| JP | 11-338266 | 12/1999 |
| JP | 2000-155501 | 6/2000 |
| JP | 2000-181309 | 6/2000 |
| JP | 2000-315023 | 11/2000 |

* cited by examiner

*Primary Examiner* — Susan S Lee
(74) *Attorney, Agent, or Firm* — Turocy & Watson, LLP

(57) ABSTRACT

In an image forming apparatus adopting a cleanerless process, there is provided a technique of preventing deterioration of picture quality due to photoreceptor filming or color mixture. An image forming apparatus of a cleanerless process in which a toner image is formed on an image bearing body by a developing unit, and a toner remaining on the image bearing body is collected by the developing unit, includes an intermediate transfer belt made of laminated layers of plural conductive materials different from each other and having a belt surface onto which the toner image is transferred from the image bearing body at a specified transfer position, and a transfer unit configured to press the intermediate transfer belt to the image bearing body at the specified transfer position and to apply a specified bias voltage to the intermediate transfer belt, wherein with respect to the plural conductive materials of the intermediate transfer belt, a layer closer to a side of either one of the toner transferred from the image bearing body and the transfer unit, where negative polarity is set, has a higher volume resistance value.

10 Claims, 10 Drawing Sheets

IMAGE FORMING APPARATUS COMPRISING AN INTERMEDIATE TRANSFER BELT

BACKGROUND OF THE INVENTION

1. Field of the Invention

The present invention relates to an image forming apparatus adopting a cleanerless process, and particularly to a technique to prevent the deterioration of picture quality due to photoreceptor filming or color mixture.

2. Description of the Related Art

Hitherto, there is known a color image forming apparatus in which development is performed by plural developing units to respectively supply toners of different colors. In the image forming apparatus of the related art as stated above, there is a case where the toner transferred on an intermediate transfer belt or a transfer member is reversely transferred to a photoconductive side in a downstream side transfer unit. In an apparatus in which a cleaner to remove the toner on the photosensitive surface is not provided, the reversely transferred toner enters the developing unit as it is, and a problem of so-called color mixture arises. The color mixture of toner as stated above causes a change in hue of an image to be printed, and causes a reduction in color reproducibility.

In order to suppress the occurrence of the reverse transfer, there is disclosed a technique in which a corona charger is provided between image forming units to prevent the reverse transfer (see, for example, JP-6-75484), a technique in which forming is performed so that a front surface contact width becomes smaller than a back surface contact width and color mixture due to the reverse transfer is prevented (see, for example, JP-A-2000-315023), or a technique in which transfer efficiency is improved, durability is improved by containing a filler, and an intermediate transfer body of a three-layer structure is provided in which a resistance difference of 100 times or more is provided between the respective layers (see, for example, JP-A-11-338266).

However, in the related art, there is a case where the occurrence of photoreceptor damage (flaw, hole, etc.) can not be suppressed according to the material of a surface layer, and filming due to the photoreceptor damage occurs.

Besides, like the technique as disclosed in JP-A-11-338266, in the case where the resistance difference of 100 times or more is provided between the respective layers of the intermediate transfer body of the three-layer structure, there is a fear that the transfer performance of the intermediate transfer body is reduced according to the value of the resistance value of the layer having the highest resistance value, and from the viewpoint that the transfer performance is kept while the reverse transfer is prevented, it is hard to say that the related art discloses the optimum relation of the resistance values of the respective layers of the intermediate transfer body.

SUMMARY OF THE INVENTION

It is an object of an embodiment of the present invention to provide a technique of preventing deterioration of picture quality due to photoreceptor filming or color mixture in an image forming apparatus adopting a cleanerless process.

In order to solve the problem, an image forming apparatus according to an aspect of the invention is an image forming apparatus of a cleanerless process in which a toner image is formed on an image bearing body by a developing unit, and a toner remaining on the image bearing body is collected by the developing unit, and which includes an intermediate transfer belt made of laminated layers of plural conductive materials different from each other and having a belt surface onto which the toner image is transferred from the image bearing body at a specified transfer position, and a transfer unit configured to press the intermediate transfer belt to the image bearing body at the specified transfer position and to apply a specified bias voltage to the intermediate transfer belt, wherein with respect to the plural conductive materials of the intermediate transfer belt, a layer closer to a side of either one of the toner transferred from the image bearing body and the transfer unit, where negative polarity is set, has a higher volume resistance value.

Besides, an image forming apparatus according to another aspect of the invention is an image forming apparatus of a cleanerless process in which a toner image is formed on an image bearing body by a developing unit, and a toner remaining on the image bearing body is collected by the developing unit, and which includes an intermediate transfer belt made of laminated layers of plural conductive materials different from each other and having a belt surface onto which the toner image is transferred from the image bearing body at a specified transfer position, and a transfer unit configured to press the intermediate transfer belt to the image bearing body at the specified transfer position and to apply a specified bias voltage to the intermediate transfer belt, wherein with respect to the conductive materials of at least two adjacent layers of the intermediate transfer belt, a layer closer to a side of either one of the toner transferred from the image bearing body and the transfer unit, where negative polarity is set, has a higher work function.

Besides, an image forming apparatus according to an aspect of the invention is an image forming apparatus of a cleanerless process in which a toner image is formed on an image bearing body by a developing unit, and a toner remaining on the image bearing body is collected by the developing unit, and which includes intermediate transfer means made of laminated layers of plural conductive materials different from each other and having a transfer surface onto which the toner image is transferred from the image bearing body at a specified transfer position, and transfer means for pressing the intermediate transfer means to the image bearing body at the specified transfer position and for applying a specified bias voltage to the intermediate transfer means, wherein with respect to the plural conductive materials of the intermediate transfer means, a layer closer to a side of either one of the toner transferred from the image bearing body and the transfer unit, where negative polarity is set, has a higher volume resistance value.

DESCRIPTION OF THE EMBODIMENTS

Hereinafter, embodiments of the invention will be described with reference to the drawings.

First Embodiment

Figure 1:
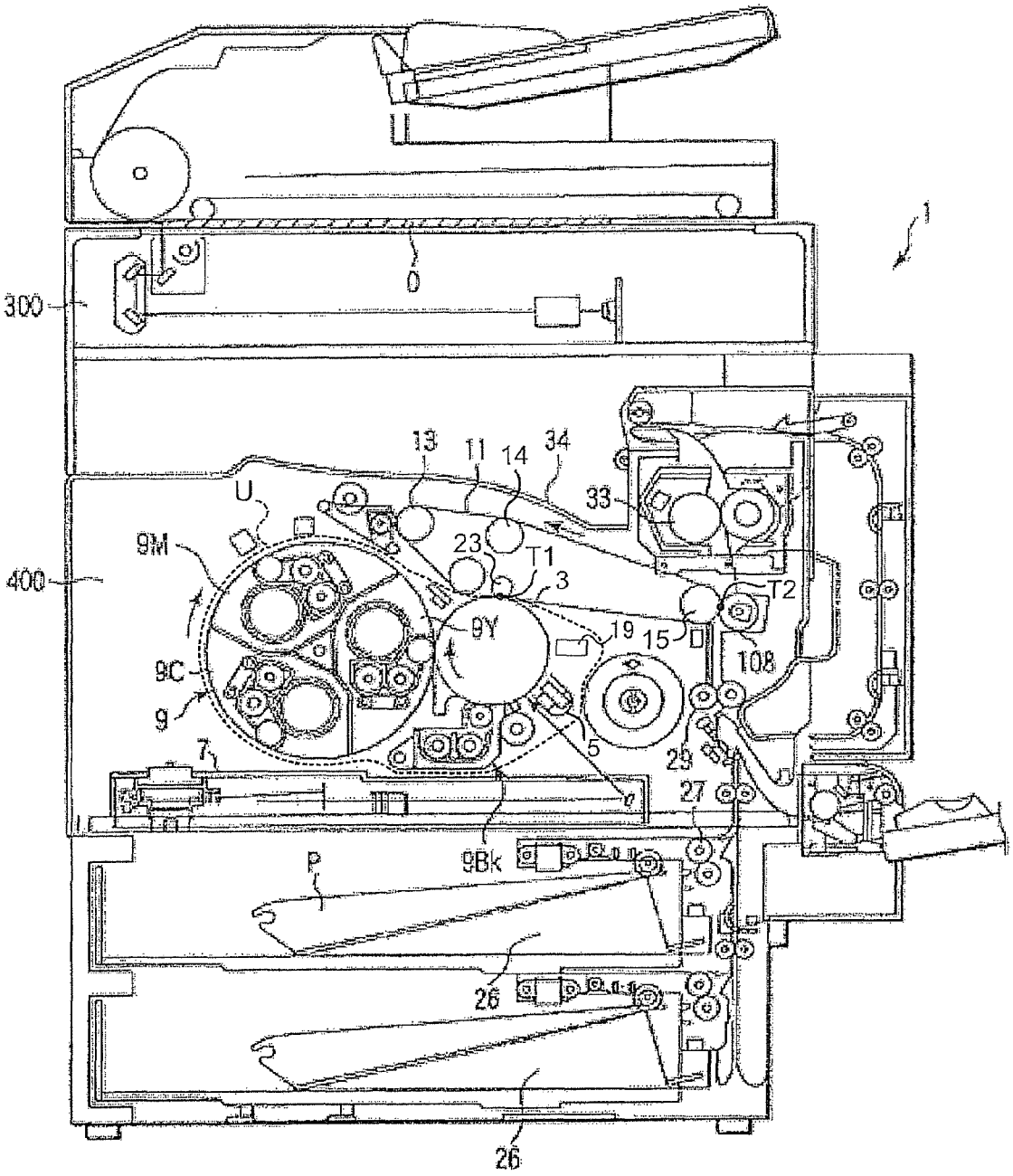
FIG. 1 is a sectional view showing a color image forming apparatus according to a first embodiment of the invention, which includes a four-rotation type image bearing body in which a color developing unit and a monochrome developing unit are separately disposed.

First, a first embodiment of the invention will be described. FIG. 1 is a sectional view showing a color image forming apparatus according to this embodiment, which includes a four-rotation type image bearing body in which a color developing unit and a monochrome developing unit are separately disposed. In FIG. 1, an image forming apparatus 1 according to this embodiment includes a photoconductive drum 3 as the image bearing body, and this photoconductive drum 3 is rotated four times so that a color developer image is formed on a sheet. The image forming apparatus 1 according to this embodiment adopts a cleanerless process in which a toner image is formed on the photoconductive drum 3 by the developing unit, and toner remaining on the photoconductive drum 3 is collected by the developing unit.

The photoconductive drum 3 has a cylindrical shape of a diameter of 100 mm, and is provided to be rotatable in an illustrated arrow direction. The following are disposed around the photoconductive drum 3 along the rotation direction. First, a charging charger 5 is provided to be opposite to the surface of the photoconductive drum 3. This charging charger 5 uniformly negatively (−) charges the photoconductive drum 3. Instead of the charging charger, contact charging by a conductive roller, a brush, a blade or the like is also possible. An exposure position where the charged photoconductive drum 3 is exposed by an exposure device 7 to form an electrostatic latent image is set at a downstream side (lower part in FIG. 1) of the charging charger 5 in the movement direction of the photosensitive surface. A developing unit 9Bk which contains a black developer and uses this developer to reversely develop the electrostatic latent image formed by the exposure device 7 is provided at the downstream side of the exposure position in the movement direction of the photosensitive surface. Besides, a developing unit 9Y to contain an yellow toner, a developing unit 9M to contain a magenta toner and a developing unit 9C to contain a cyan toner are supported to be rotatable with respect to the photoconductive drum 3 at the downstream side of the developing unit 9Bk in the movement direction of the photosensitive surface (rotation development unit).

Further, an intermediate transfer belt 11 which primarily transfers the color toner image formed on the photoconductive drum 3 at a primary transfer position T1 and holds the color image is disposed at the downstream side of the rotation development unit in the movement direction of the photosensitive surface. The photoconductive drum 3 is rotated four times and when the color image is formed on the intermediate transfer belt 11, the developer images formed on the intermediate transfer belt 11 are collectively transferred at a secondary transfer position T2 onto a transported sheet P. An antistatic lamp 19 is provided at the downstream side of the contact position (primary transfer position T1) between the photoconductive drum 3 and the intermediate transfer belt 11 in the movement direction of the photosensitive surface.

The antistatic lamp 19 eliminates the surface charge on the photoconductive drum 3 by uniform light irradiation after the primary transfer. One cycle of the image formation is completed by the charge elimination by this antistatic lamp 19, and in the next image formation process, the charging charger 5 again uniformly charges the non-charged photoconductive drum 3. This process is repeated four times, so that color toner images of four colors of yellow, magenta, cyan and black are formed on the intermediate transfer belt. The intermediate transfer belt 11 is set to have substantially the same width as the size of the photoconductive drum 3 in the longitudinal direction. The intermediate transfer belt 11 has a shape of an endless (seamless) belt, and is supported on a driving roller 15 to rotate the intermediate transfer belt 11 at a specified speed, a driven roller 13, and a tension roller 14 to apply tension to the belt. The driving roller 15 and the driven roller 13 are provided to be rotatable in an illustrate arrow direction. The intermediate transfer belt 11 is rotated in accordance with the rotation of the driving roller 15, and the driven roller 13 is driven-rotated. In addition to those, a contactable and separable cleaning device 10 is disposed above the intermediate transfer belt 11. The cleaning device 10 includes a rubber blade or a brush. In a period in which the color image is primarily transferred on the intermediate transfer belt 11, the cleaning device 10 is separate from the belt. After the toner images are secondarily transferred onto the sheet P, the cleaning device 10 is brought into contact with the surface of the intermediate transfer belt 11.

The intermediate transfer belt 11 has a multi-layer structure in which at least two kinds of conductive materials are laminated.

As specific materials to constitute the respective layers of the intermediate transfer belt 11, for example, in addition to polyimide in which carbon is uniformly dispersed, polyethylene terephthalate, polycarbonate, polytetrafluoroethylene, polyvinylidene fluoride or the like in which conductive particles of carbon or the like are dispersed can be adopted. In addition to those, a polymeric film in which electric resistance is adjusted by composition adjustment without using conductive particles may be used. Further, a material in which an ion conductive material is mixed in such a polymeric film, or a rubber material, such as silicone rubber or urethane rubber, having a relatively low electric resistance can also be adopted.

This intermediate transfer belt 11 has an electric resistance of 10e10 Ωcm, and exhibits semiconductivity. As the material of the intermediate transfer belt 11, any material is used as long as the volume resistance value is 10e9 to 10e13 Ωcm and exhibits the semiconductivity. The details of the structure of the intermediate transfer belt will be described later.

A secondary transfer roller 108 is disposed to be opposite to the driving roller 15. The secondary transfer roller 108 can perform the operation of contact and separation with respect to the intermediate transfer belt 11, and is separate therefrom when the toner image is primarily transferred onto the intermediate transfer belt 11. After the color toner images of four colors are formed on the intermediate transfer belt 11, the secondary transfer roller 108 comes in contact with the intermediate transfer belt 11, forms a secondary transfer area T2, and collectively secondarily transfers the toner images onto the transported sheet P. In the vicinity of the contact position (primary transfer area T1) between the intermediate transfer belt 11 and the photoconductive drum 3, a transfer device (transfer unit) 23 as primary transfer means is provided to be opposite to the photoconductive drum 3. That is, the transfer device 23 is provided above the corresponding photoconductive drum 3 to be in contact with the back of the intermediate transfer belt 11, and is opposite to the photoconductive drum 3 through the intermediate transfer belt 11.

Next, a portion relating to the transfer device 23 will be further described in detail. The transfer device 23 is a conductive urethane foam roller which is made conductive by dispersing carbon. The roller with an outer diameter of ϕ18 mm is formed on a cored bar of ϕ10 mm. The electric resistance between the cored bar and the surface of the roller is about 10e6Ω. A positive (+) constant voltage DC power source 25 as voltage application means is connected to the cored bar. As stated above, the transfer device 23 presses the intermediate transfer belt 11 to the photoconductive drum 3 in the first transfer area, and applies a specified bias voltage to the intermediate transfer belt 11.

A power feeding device in the transfer device 23 is not limited to the roller, but may be a conductive brush, a conductive rubber blade, a conductive sheet or the like. The conductive sheet is a rubber material dispersed with carbon or resin film, and may be a rubber material, such as silicone rubber, urethane rubber or EPDM, or a resin material such as polycarbonate, and a material having a volume resistance value is 10e5 to 10e7 Ωcm is desirable.

In FIG. 1, a paper feed cassette 26 to contain sheets P is provided at a lower part of the image forming apparatus 1. A pickup roller 27 to pick up the sheets P from the paper feed cassette 26 one by one is provided in the main body of the image forming apparatus. A register roller pair 29 is rotatably provided between the pickup roller 27 and the intermediate transfer belt 11. The resist roller pair 29 supplies the sheet P at a specified timing to a secondary transfer part in which the intermediate transfer belt and the secondary transfer roller are opposite to each other.

Besides, in FIG. 1, a fixing unit 33 to fix the developer onto the sheet P and a paper discharge tray 34 to which the sheet P fixed by the fixing unit 33 is discharged are provided at an upper part of the secondary transfer part.

In a process unit U, the photoconductive drum 3 and at least one of the black toner developing unit 9Bk (corresponding to a collection unit) and the rotation development unit are integrally supported, and it is attachable to and detachable from the main body of the image forming apparatus 1. As shown in FIG. 1, in this embodiment, as an example, the process unit U includes the rotation development unit, the photoconductive drum 3 and the black toner developing unit 9Bk. Of course, the structure of the process unit U can also be made such a structure as to include portions other than the photoconductive drum and the developing unit according to the restriction of space in the image forming apparatus, the arrangement of parts and the like.

Next, a color image forming process in the image forming apparatus structured as described above will be described. When an image forming processing start is instructed through a not-shown operation panel (Control panel) located at the front of the image forming apparatus 1, the photoconductive drum 3 receives a drive force from a not-shown drive mechanism and starts to rotate. The charging charger 5 uniformly charges the photosensitive surface of the photoconductive drum 3 to about −600 V. The exposure device 7 irradiates a light corresponding to an image to be formed to the photoconductive drum 3 uniformly charged by the charging charger 5, and forms an electrostatic latent image on the photosensitive surface. The developing unit 9 develops the electrostatic latent image by the developer to form an yellow developer image.

When the yellow toner image formed on the photoconductive drum 3 reaches the primary transfer area T1 formed of the photoconductive drum 3, the intermediate transfer belt 11 and the transfer member 23, a bias voltage of about +1000 V is applied to the transfer member 23. A transfer electric field is formed between the transfer member 23 and the photoconductive drum 3, and the yellow developer image on the photoconductive drum 3 is transferred onto the intermediate transfer belt 11 in accordance with this transfer electric field in the primary transfer area T1 where it comes in contact with the intermediate transfer belt 11. The yellow toner remaining on the photoconductive body after the primary transfer is subjected to development simultaneous cleaning by the yellow developing unit.

When the development by the yellow developing unit is ended, the development roller of the magenta developing unit 9M is rotated to be opposite to the photoconductive drum 3.

Next, advance is made to the development processing of the magenta toner, and a magenta toner image is transferred onto the intermediate transfer belt 11 in the primary transfer area T1. The residual transfer toner of the magenta toner is subjected to simultaneous collection development by the magenta developing unit. Hereinafter, also in the cyan toner image formation process, the development processing by the cyan developer 9C is performed similarly.

In this embodiment, the black developing unit is provided independently of the color developing unit. The black developing unit is a contact non-magnetic one-component developing unit, and at the time of BK development, a normal voltage of (−)350 V is applied, and the development simultaneous cleaning of the cleanerless process is performed. After the color toner image is formed, the black toner image is subsequently formed. At the time of the black toner image formation process, the simultaneous collection development of the residual transfer black toner is performed by the black developing unit.

When the toner images of the four colors are formed on the intermediate transfer belt 11, next, at the timing when the toner images reach the secondary transfer area T2 where the intermediate transfer belt and the secondary transfer roller are opposite to each other, the resister roller pair 29 supplies the sheet P, which has been previously picked up by the pickup roller and has been transported to the resister roller pair 29, to the secondary transfer area T2.

At this time, the secondary transfer roller performs the contact operation to the intermediate transfer belt, and is applied a DC bias voltage of about (+)2000 V. The toner images are transferred onto the sheet P by the transfer electric field formed by this bias voltage. The collectively transferred developer images as stated above are fixed on the sheet P by the fixing unit 33, and the color image is formed. The sheet P already fixed is discharged onto the paper discharge tray 34.

The secondary transfer roller is separated after the transfer. The residual toner on the intermediate transfer belt 11 after the end of the secondary transfer is collected by the intermediate transfer belt cleaner 10. The waste toner collected by the intermediate transfer belt cleaner 10 is transported to the black developing unit by a not-shown transport unit and is reused.

Figure 2:
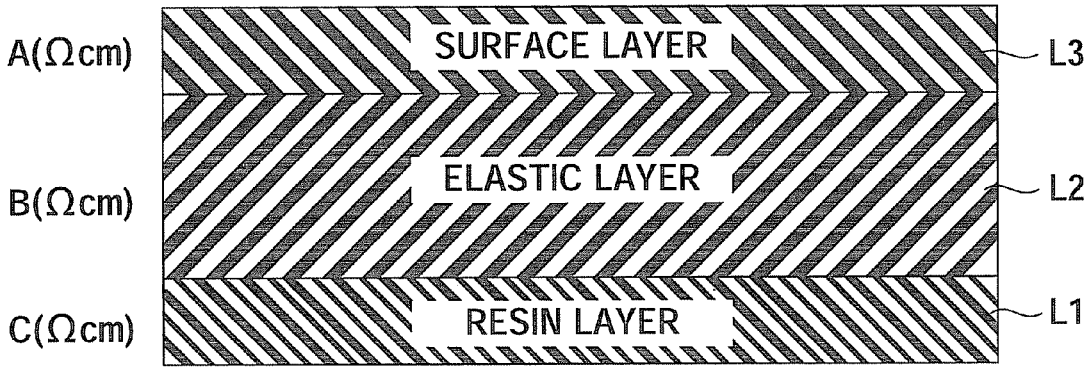
FIG. 2 is a sectional view showing a laminate structure of an intermediate transfer belt 11 in the first embodiment of the invention.

Hereinafter, the details of the structure of the intermediate transfer belt 11 in this embodiment will be described. FIG. 2 is a sectional view showing a laminate structure of the intermediate transfer belt 11 in this embodiment.

As shown in FIG. 2, the intermediate transfer belt 11 in this embodiment is a three-layer structure elastic belt in which a resin layer L1, an elastic layer L2 and a surface layer L3 are laminated.

In this embodiment, the resin layer (base material layer) L1 is a polyimide layer, the elastic layer L2 is an urethane rubber layer, and the surface layer L3 is a fluorine rubber layer. Incidentally, as the elastic layer L2, silicone rubber or another rubber material may be adopted. As the surface layer L3, urethane rubber can also be adopted. Of course, the materials of the respective layers described here are merely examples, and no limitation is made to this. However, it is preferable that the layer closest to the side where toner is transferred is made of an elastic material.

Incidentally, in this embodiment, the magnitude relation of volume resistance values of the respective layers is the point. Here, the volume resistance value C (Ωcm) of the resin layer L1 is 10e9 Ωcm, the volume resistance value B (Ωcm) of the elastic layer L2 is 10e10 Ωcm, and the volume resistance value A (Ωcm) of the surface layer L3 is 10e11.5 Ωcm.

That is, the plural conductive materials of the intermediate transfer belt 11 are set so that a layer closer to a side of either one of the toner transferred from the photoconductive drum 3 and the transfer device 23, where negative polarity is set (here, the side of the photoconductive drum 3), has a higher volume resistance value. As stated above, the resistance value at the minus polarity side is made high, so that the layer is made to have the function as a blocking layer against discharge occurrence or charge injection, and the problem of the reverse transfer due to the toner reverse charge, which is the problem of the intermediate transfer belt of the related art, can be prevented, and the cleanerless color image forming apparatus without the color mixture can be provided.

Here, since the resistance value of the resin layer L1 is 10e8 to 10e9 Ωcm, when the resistance value of an upper layer is smaller than this, a transfer current flows laterally in the layer, and in a tandem structure image forming apparatus, there occurs a disadvantage that the current interferes with the transfer in the adjacent process unit and exerts a bad influence. Besides, when the volume resistance value is 10e13 Ωcm or higher, the charge-up of the intermediate transfer belt 11 occurs, and a disadvantage occurs in repeated transfer.

Accordingly, with respect to conductive materials of two adjacent layers of the intermediate transfer belt 11, when the volume resistance value of the layer closer to the side of either one of the toner transferred from the image bearing body and the transfer unit, where the negative polarity is set, is R2, and the volume resistance value of the layer closer to the side where the positive polarity is set is R1, it is preferable that the conductive materials satisfy the following relation of $$R1<R2<R1\times 100.$$

Specifically, for example, it is preferable that an upper layer is higher in the range of 10e8 Ωcm<C<B<A<10e13 Ωcm, and in order to provide the function as the blocking layer, it is preferable that a difference of about 10 times in the resistance value is provided between C (Ωcm) and B (Ωcm) or between B (Ωcm) and A (Ωcm).

Next, in this embodiment, the grounds why the relation of less than 100 times is made to be established between the volume resistance values of two adjacent layers of the intermediate transfer belt 11 will be described.

With respect to the surface resistance of a laminate belt, the description has been made such that the volume resistance value of the layer at the side of the image bearing body is set to be higher than that of the layer at the side of the transfer roller, so that the reverse charge of toner is prevented and the reverse transfer is prevented by the effects of the blocking of charge injection or the suppression of occurrence of abnormal discharge. However, it is not always the case that the larger the difference in the respective volume resistance values is, the better, and when the difference in the volume resistance values is excessively large, there occurs a disadvantage that uneven transfer occurs. Hereinafter, this will be described in detail.

Seven kinds of samples in which the volume resistance of a polyimide base material layer was 1*10e9 Ωcm, the volume resistance of a middle rubber layer of urethane was 1*10e10 Ωcm, and the volume resistances of surface layers were respectively 1*10e10, 5*10e10, 1*10e11, 5*10e11, 1*10e12, 5*10e12 and 1*10e13 Ωcm were manufactured by way of experiment.

Figure 3:
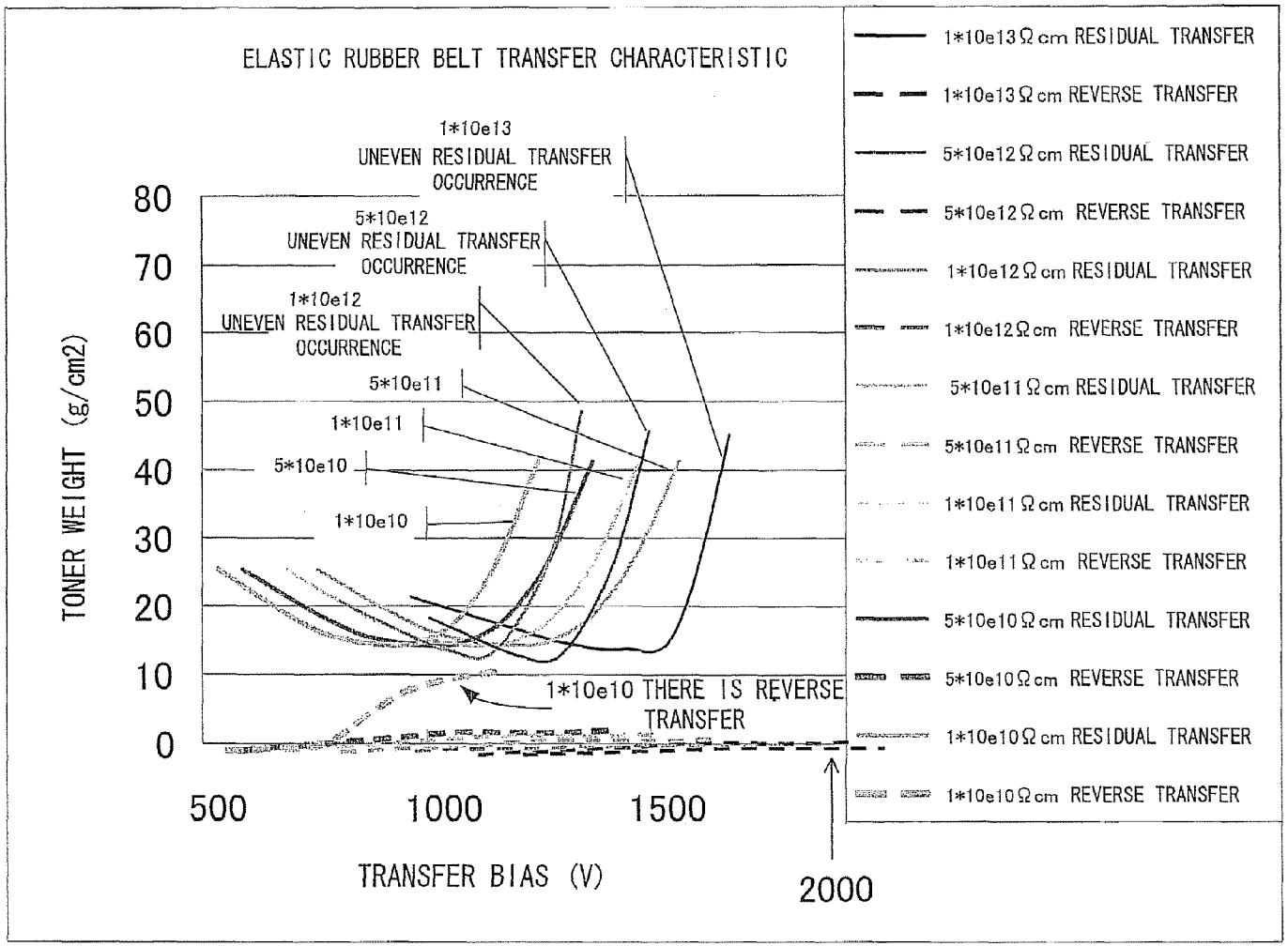
FIG. 3 is a graph showing results in which transfer characteristics of seven kinds of samples are evaluated.

FIG. 3 is a graph showing results in which transfer characteristics of the seven kinds of samples are evaluated. In the surface layer of 1*10e10 Ωcm, the function as the blocking layer is not seen, and the effect of reduction of reverse transfer is unsatisfactory. From 5*10e10 Ωcm or higher, the effect of reduction of reverse transfer is seen. However, on the other hand, in the samples in which the surface resistance of the surface layer is 1*10e12 Ωcm or higher, when the transfer bias is raised, the unevenness of residual transfer becomes severe, and the result is such that the amount of transfer residual toner is abruptly increased.

Figure 4:
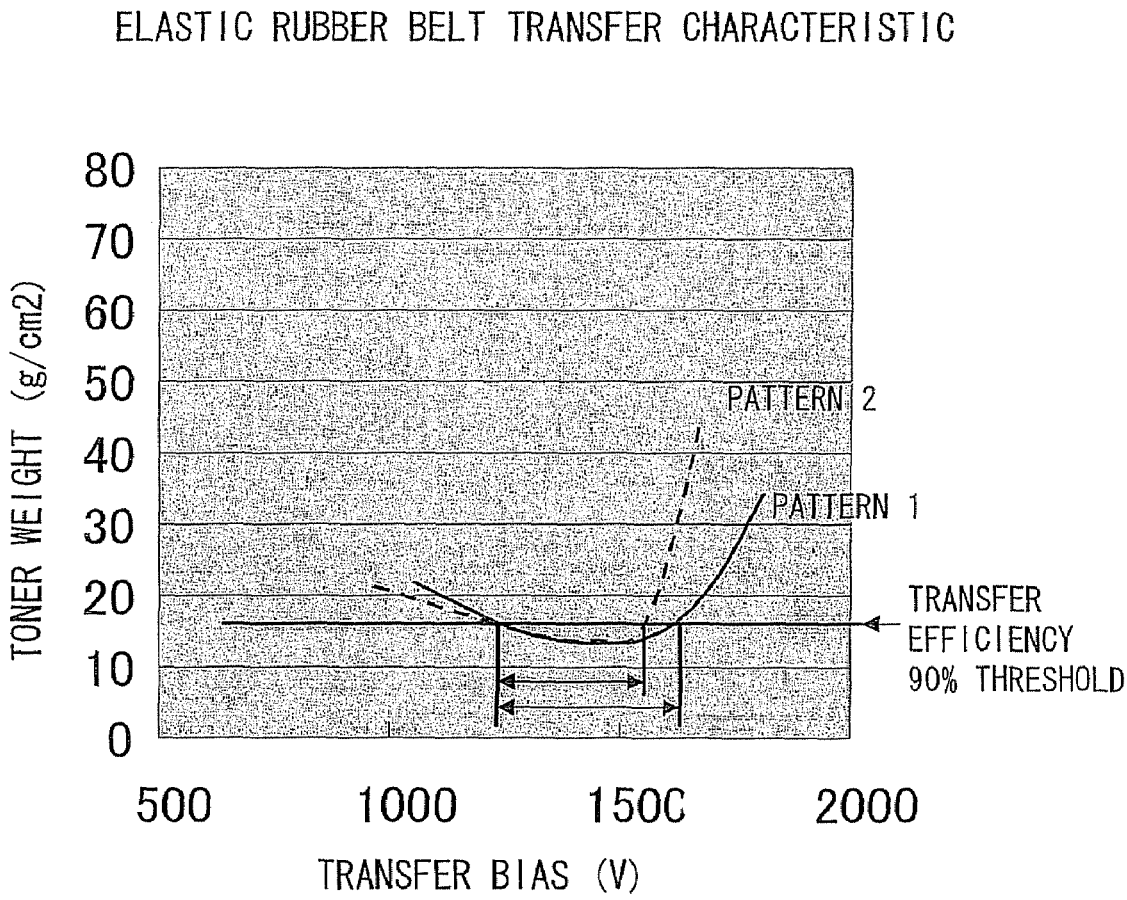
FIG. 4 is a view showing two patterns obtained by classifying the residual transfer characteristics shown in FIG. 3.

FIG. 4 is a view showing two patterns obtained by classifying the residual transfer characteristics shown in FIG. 3. When an area of a transfer efficiency of 90% or higher is seen, it can be said that pattern 1 has a wider optimum transfer area. In pattern 2, the transfer characteristic is abruptly deteriorated and the amount of residual transfer toner is increased, and therefore, the optimum transfer area becomes narrow.

That is, it is understood that when the difference in the surface resistances is 100 times or more, the range of the optimum transfer becomes narrow. Especially, in the cleanerless process, when the amount of residual transfer toner becomes large, a memory image is generated, and therefore, this is fatal.

As stated above, it is not preferable that the difference in the volume resistance values between the adjacent layers of the intermediate transfer belt is too small or too large, and it is desirable that the difference falls within the range of less than 100 times. Here, in the case of the example shown in FIG. 3, in the range of 5*10e10 to 5*10e11 Ωcm, the reverse transfer does not exist, the uneven transfer does not occur, and it is the optimum range.

Figure 5:
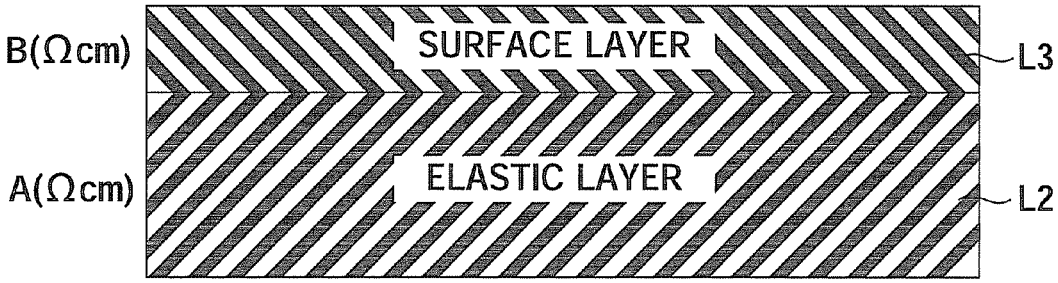
FIG. 5 is a sectional view showing another example of the laminate structure of the intermediate transfer belt 11.

Incidentally, in this embodiment, although the example has been described in which the intermediate transfer belt 11 has the three-layer structure, no limitation is made this, and as shown in FIG. 5, a two-layer structure may be adopted, or a multi-layer structure of four or more layers may be adopted. In the structure shown in FIG. 5, when the volume resistance value of an elastic layer L2 is made A (Ωcm), it is desirable that the volume resistance value B (Ωcm) of a surface layer L3 is larger than A (Ωcm) and less than 100 times as large as A (Ωcm).

Second Embodiment

Next, a second embodiment of the invention will be described.

Since this embodiment is a modified example of the first embodiment, a portion having the same function as a portion described in the first embodiment is denoted by the same symbol, and its explanation will be omitted. This embodiment is different from the first embodiment in the characteristics of materials constituting an intermediate transfer belt.

In this embodiment, the conductive materials of at least two adjacent layers of the intermediate transfer belt 11 are set so that the layer closer to the side of either one of toner transferred from a photoconductive drum 3 and a transfer device 23, where negative polarity is set, has a higher work function (eV).

Figure 6:
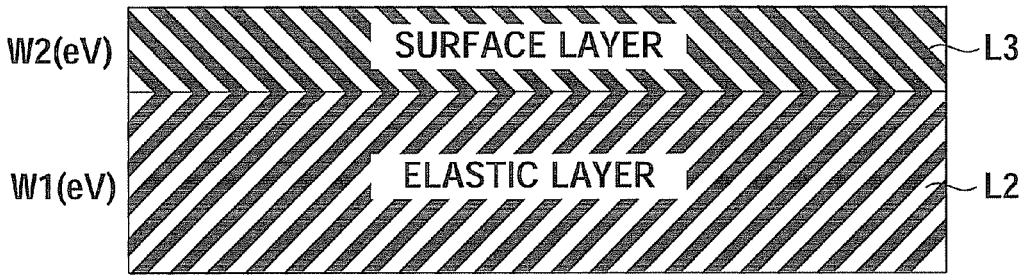
FIG. 6 is a sectional view showing a laminate structure of an intermediate transfer belt 11 according to a second embodiment of the invention.

As shown in FIG. 6, the intermediate transfer belt in this embodiment has a two-layer structure in which an elastic layer L2 and a surface layer L3 are laminated, and is set so that a work function W2 (eV) of the surface layer L3 is higher than a work function W1 (eV) of the elastic layer L2.

In the apparatus in which the toner has a minus charge, and the polarity of the transfer device 23 is set to be plus, a plus voltage as a transfer bias is applied to a transfer roller, so that the toner is transferred onto the intermediate transfer belt. In the structure as stated above, in order to prevent a plus charge from being injected into the toner, the materials are made such that the work function of an upper layer is higher than the work function of a lower layer, so that the layer (here, the surface layer L3) close to the photoconductive drum 3 has the function as the blocking layer, and the occurrence of reverse transfer of toner can be greatly suppressed.

Figure 7:
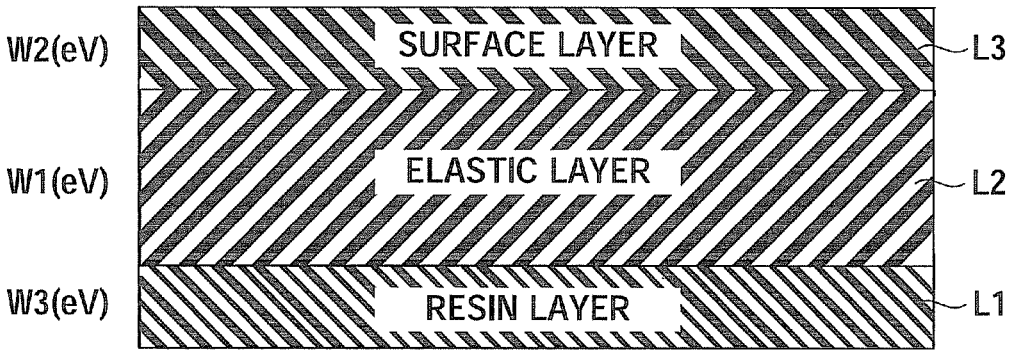
FIG. 7 is a sectional view showing another example of the laminate structure of the intermediate transfer belt 11.

Incidentally, in this embodiment, although the example in which the intermediate transfer belt 11 has the two-layer structure has been described, no limitation is made to this, and for example, as shown in FIG. 7, a three-layer structure of a resin layer L1, an elastic layer L2 and a surface layer L3 may be adopted. In this case, it is not always necessary that the magnitude relation of the work function is given as follows:

work function W3 of the resin layer L1<work function W1 of the elastic layer L2<work function W2 of the surface layer L3, and the relation of the work functions of at least any adjacent two layers has only to be set so that the layer closer to the side of either one of the toner transferred from the photoconductive drum 3 and the transfer device 23, where the negative polarity is set, has a higher work function (eV). That is, at least one of conditions of the work function W3<the work function W1 and the work function W1<the work function W2 has only to be satisfied.

Of course, the plural conductive materials of the intermediate transfer belt 11 may be structured such that a layer closer to the side of either one of the toner transferred from the photoconductive drum 3 and the transfer device 23, where the negative polarity is set, has a higher work function.

Besides, the intermediate transfer belt 11 is not limited to the above structure, but can be made to have a multi-layer structure of four or more layers, and when the above relation is established between any two adjacent layers, the function as the blocking layer can be obtained.

As one example of the structure of the intermediate transfer belt in this embodiment, there is given a structure in which a surface layer of urethane is laminated on a resin layer (base material layer) of a polyimide belt, or a structure in which a surface layer of fluorine rubber is laminated on a resin layer of a polyimide belt, and in the structure as stated above, there is an effect in reduction of reverse transfer toner. The work function of the belt material was measured by "AC-1" of Riken Keiki Co., Ltd. When the work function of polyimide is measured, it is 4.94 eV. On the other hand, the result of measurement of the work function of the urethane layer is 5.51 eV. The result of measurement of the work function of fluorine rubber is 5.28 eV.

Figure 8:
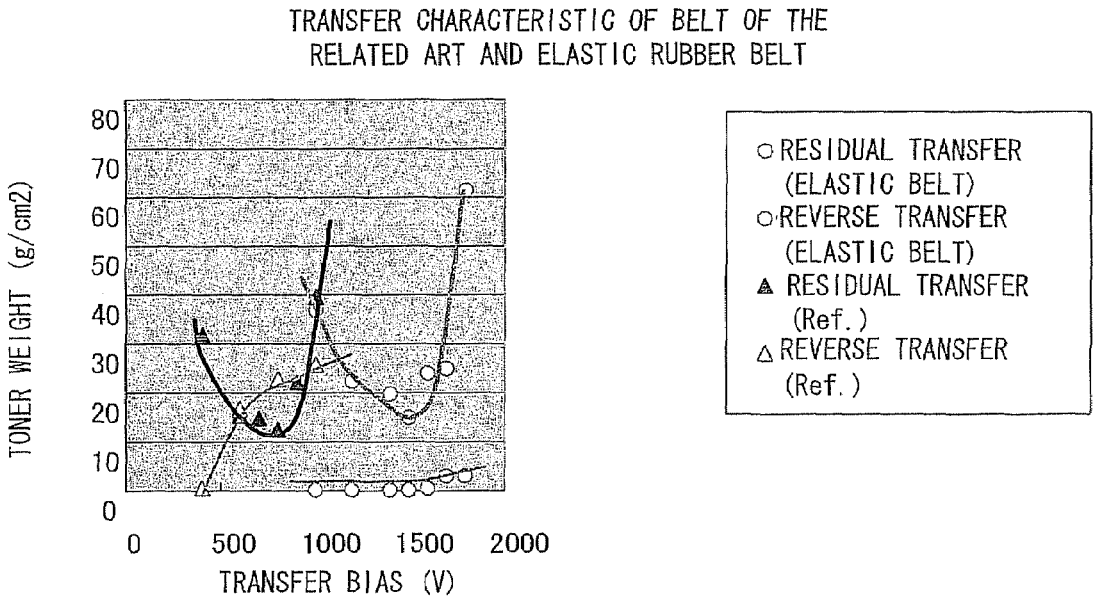
FIG. 8 is a graph showing results of evaluation of the amount of residual transfer toner and the amount of reverse transfer toner in the case where an intermediate transfer belt of the related art and the intermediate transfer belt of the embodiment are used.

FIG. 8 is a graph showing results in which the amount of residual transfer toner on the photoconductive drum and the amount of reverse transfer toner are evaluated in a case where an intermediate transfer belt of the related art is used and in a case where the intermediate transfer belt of the two-layer structure according to this embodiment is used.

Third Embodiment

Next, a third embodiment of the invention will be described.

In the case where an intermediate transfer belt is a belt with low durability against abrasion like an elastic rubber belt, as a cleaning device to remove toner attached to the belt surface of the intermediate transfer belt, it is preferable to adopt a structure in which a metal roller, a rubber roller or a rotation brush is brought into contact with the belt surface.

Figure 9:
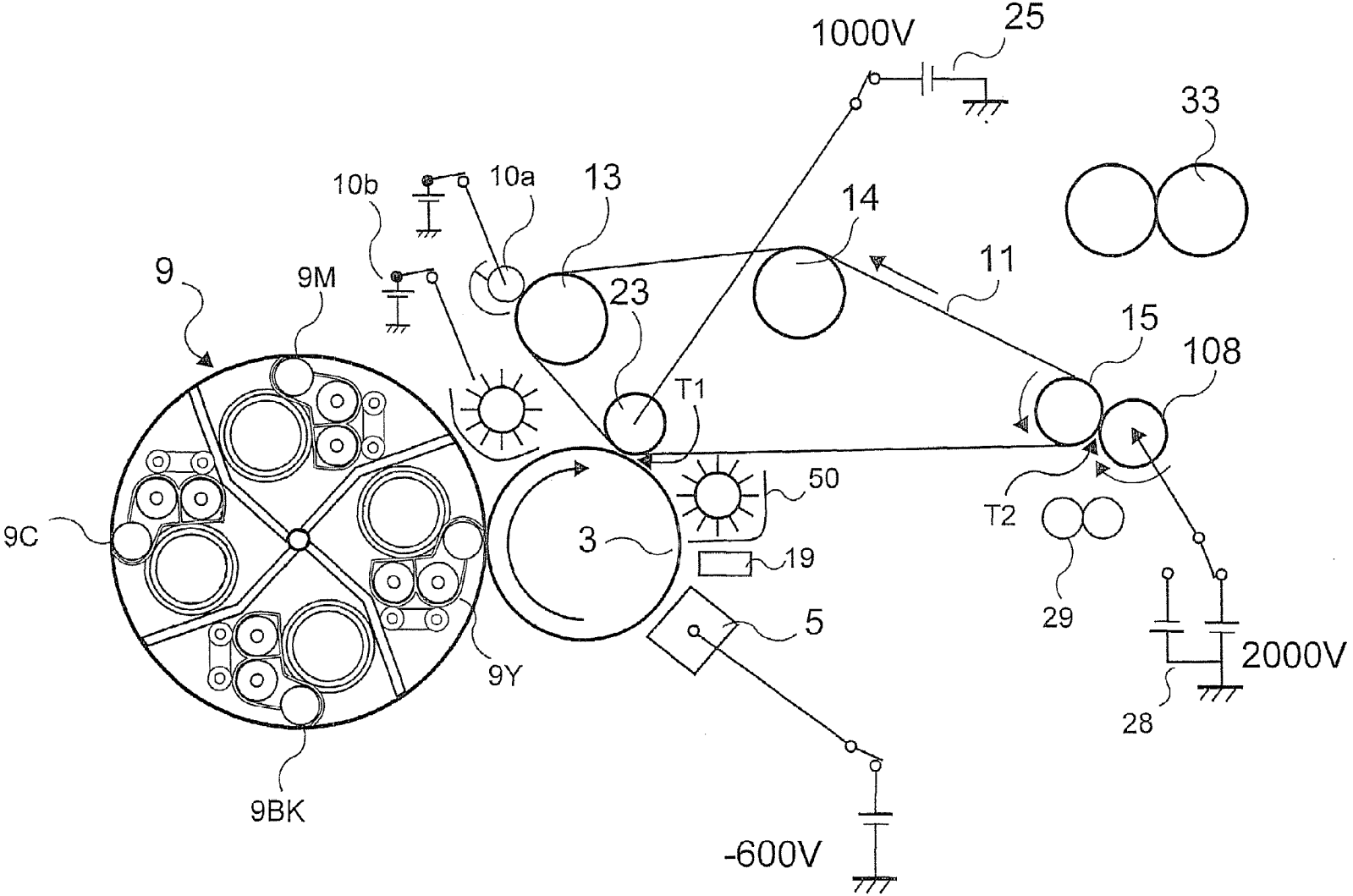
FIG. 9 is a sectional view showing a structure around a process unit of a four-rotation type color image forming apparatus according to a third embodiment of the invention.

FIG. 9 is a sectional view showing a structure around a process unit of a four-rotation type color image forming apparatus according to this embodiment. In the image forming apparatus according to this embodiment, developing units of four colors of Y, M, C and Bk are fitted in one rotation development unit, and a collecting device 50 to temporarily collect residual transfer toner is disposed. After primary transfer in a primary transfer area T1, the transfer residual toner remaining on a photoconductive drum 3 is collected by the collecting device 50.

In the structure shown in the drawing, the collecting device 50 is a rotation brush. The rotation brush of the collecting device can come in contact with and be separated from the photoconductive drum 3 at a specified timing. The contact and separation of the collecting device 50 here can be performed by operating a cam at the specified timing by using an electromagnetic clutch.

A first timing when the rotation brush comes in contact with the photoconductive drum 3 is such that development toner images of respective colors are transferred in a primary transfer area T1, and then, the developing unit is switched and in conformity with the timing when the toner remaining as the residual transfer toner on the photoconductive drum 3 is collected into the switched developing unit, and actually, the contact of the rotation brush is performed at a timing when the residual transfer toner is not collected into the switched developing unit, and the residual transfer toner is collected in the contact part. At this time, a bias voltage of (+)300 V is applied to the rotation brush. The rotation brush is rotated in the same direction (with) as the photoconductive drum, and is driven to rotate at a rotation speed twice as fast as the photoconductive drum.

A second timing when the rotation brush comes in contact with the photoconductive drum 3 is a timing when the collected toner is discharged by the collecting brush when the Bk developing unit is opposite to the photoconductive drum, and the Bk development is performed. A bias voltage of (−)600 V is applied to the rotation brush. Alternatively, bias voltages of (+)300 V and (−)600 V may be alternately repeatedly applied. By this, the collected toner is discharged from the brush and is collected into the Bk developing unit. In this embodiment, although the toner discharge from the collection brush is performed at the time of Bk development, it is preferable that independent control is provided as a discharge mode, and the discharge operation is performed at the time of non-printing. Further, in the image forming apparatus including an intermediate transfer belt cleaning device, the toner collected from the collecting device of the transfer residual toner on the photoconductive drum is discharged at the time of non-printing and may be collected by the intermediate transfer belt cleaning device. In this case, the collected toner is transported to the Bk developing unit and is recycled and used.

In this embodiment, a metal roller 10*a* to which a bias of +100 V is applied is brought into contact with an intermediate transfer belt 11 at a position where it is opposite to a transfer belt driving roller, and the toner attached to the metal roller 10*a* is removed by an elastic sheet. Further, at the downstream side of the metal roller 10*a* in the movement direction of the intermediate transfer belt, a rotation brush 10*b* which is made of a conductive acryl fiber and to which a bias voltage of +300 V is applied is brought into contact with the intermediate transfer belt 11, so that the remaining toner which can not be collected by only the metal roller 10*a* is collected. The rotation brush 10*b* is rotated in the with direction at a speed 1.5 times as fast as the intermediate transfer belt 11.

Fourth Embodiment

Next, a fourth embodiment of the invention will be described.

Figure 10:
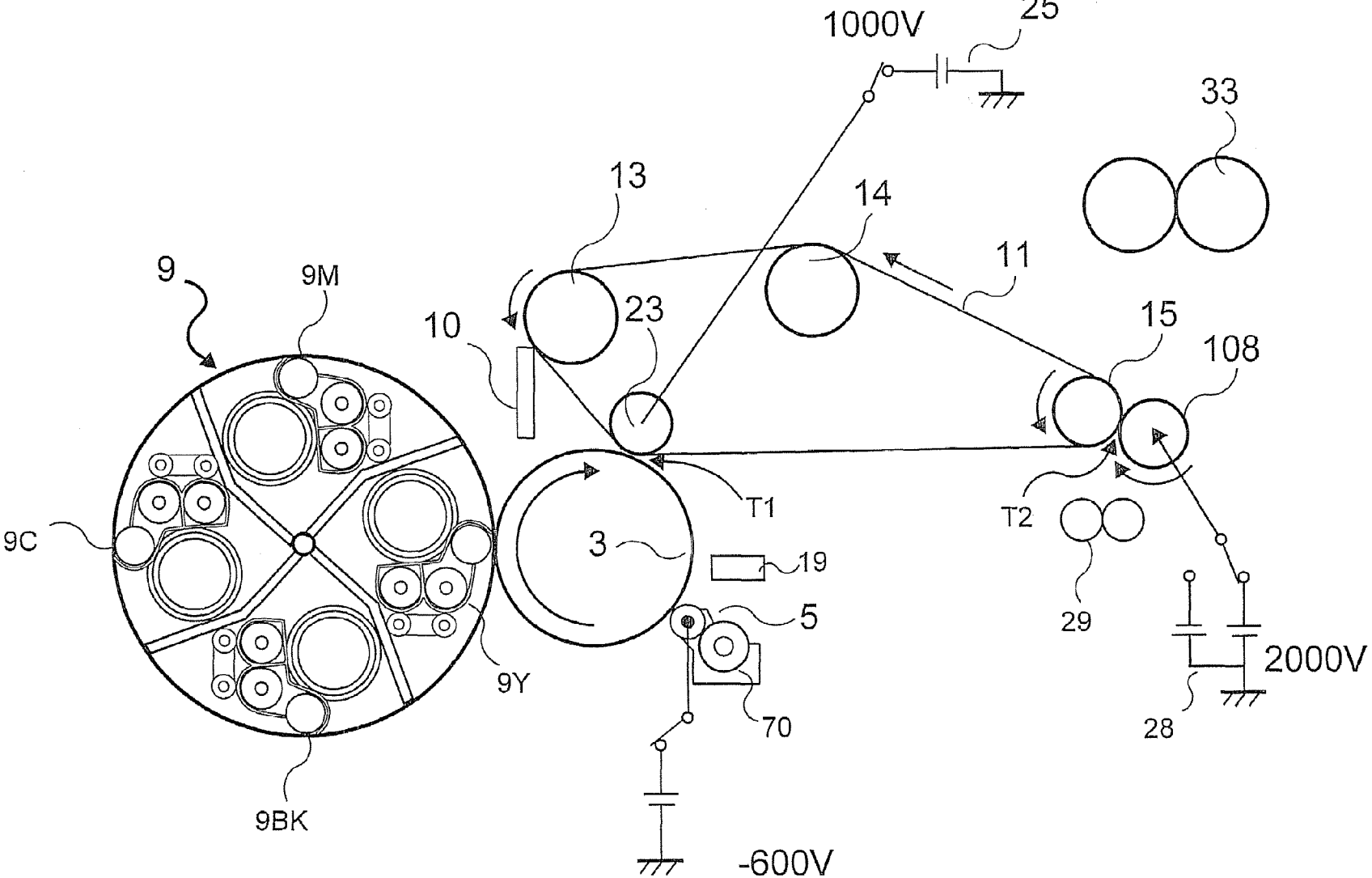
FIG. 10 is a sectional view showing a structure around a processing unit of an image forming apparatus according to a fourth embodiment of the invention.

FIG. 10 is a sectional view showing a structure around a process unit in an image forming apparatus according to this embodiment.

As shown in the drawing, in this embodiment, as a charging device 5 to charge a photoconductive surface, a contact charging type one using an electrostatic flocked brush is adopted. Here, as the brush fiber degree of the electrostatic flocked brush, a thin fiber of 3 denier or lower is adopted, and uniform charging becomes possible by this.

Hitherto, unless the fiber degree is about 6 denier, the strength of the fiber is insufficient, and brush formation can not be performed by a loom. However, a thin fiber uniform brush can be formed by adopting the electrostatic flocking method of forming the brush by attaching the fiber with static electricity. In the charging device 5, the photoconductive surface is charged by the electrostatic flocked brush, and the toner remaining on the photoconductive body is electrically collected.

Incidentally, the transfer characteristic of toner having an average grain diameter of 80 to 150 nm and externally added with silica in the range of external addition amount of 1 to 3 wt. % is very excellent, and remaining transfer and reverse transfer is small. However, when silica with a relatively large grain diameter is externally added, damage to the photoreceptor is serious, and the photoreceptor is required to have durability. Then, by combining and using the intermediate transfer belt as in each of the foregoing embodiments and the amorphous silicon photoreceptor, it is possible to provide the cleanerless color image forming apparatus in which the reverse transfer is small, and a sufficient photoreceptor life can be obtained.

Besides, in the foregoing respective embodiments, the toner has the minus charge (the side where the minus polarity is set), and the transfer device 23 is set to have the plus polarity, however, no limitation is made to this, and it is needless to say that the structure is made such that the toner is plus charged, and the polarity at the side of the transfer device 23 is made minus. In this case, the side of either one of the toner transferred from the photoconductive drum and the transfer device 23, where the negative polarity is set, is the side of the transfer device 23.

Incidentally, in the foregoing respective embodiments, although the example has been described in which the toner image is transferred onto the intermediate transfer belt rotating four times by using the rotation development unit, that is, the so-called four-rotation intermediate transfer system is adopted, no limitation is made to this. For example, a so-called four-series tandem intermediate transfer system can be adopted in which plural process units provided for respective toner colors used are arranged along the movement direction of the belt surface of an intermediate transfer belt, and toner images of toners of all colors are formed on the belt surface by only one rotation of the intermediate transfer belt.

As stated above, according to this embodiment, in the color image forming apparatus adopting the photoreceptor cleanerless process, the occurrence of deterioration of picture quality due to the filming or color mixture can be suppressed.

Although the invention has been described using the specific embodiments, it would be apparent for one of ordinary skill in the art that various modifications and improvements can be made without departing from the sprit and scope of the invention.

As described above in detail, according to the invention, in the image forming apparatus adopting the cleanerless process, the technique to prevent the deterioration in picture quality due to the photoreceptor filming or color mixture can be provided.

What is claimed is:

1. An image forming apparatus of a cleanerless process in which a toner image is formed on an image bearing body by a developing unit, and a toner remaining on the image bearing body is collected by the developing unit, the image forming apparatus comprising:

an intermediate transfer belt made of laminated layers of plural conductive materials different from each other and having a belt surface onto which the toner image is transferred from the image bearing body at a specified transfer position; and a transfer unit configured to press the intermediate transfer belt to the image bearing body at the specified transfer position and to apply a specified bias voltage to the intermediate transfer belt, wherein with respect to the plural conductive materials of the intermediate transfer belt, a layer closer to a side of either one of the toner transferred from the image bearing body and the transfer unit, where negative polarity is set, has a higher volume resistance value, and wherein with respect to the conductive materials of two adjacent layers of the intermediate transfer belt, when a volume resistance value of the layer closer to the side of either one of the toner transferred from the image bearing body and the transfer unit, where the negative polarity is set, is R2, and a volume resistance value of the layer closer to the side where positive polarity is set is R1, the conductive materials satisfy a relation of $R1<R2<R1\times 100$.

2. The image forming apparatus according to claim 1, wherein in the intermediate transfer belt, at least the layer closest to the side where the toner is transferred is made of an elastic material.

3. The image forming apparatus according to claim 1, wherein the negatively charged toner is transferred from the image bearing body onto the intermediate transfer belt, and the transfer unit applies a bias voltage in which the polarity of the transfer unit becomes positive.

4. The image forming apparatus according to claim 1, further comprising a charger which charges a surface of the image bearing body by a brush and can electrically collect the toner remaining on the image bearing body.

5. The image forming apparatus according to claim 1, wherein the image bearing body and the developing unit are integrally supported as a process unit, and are attachable to and detachable from the image forming apparatus.

6. An image forming apparatus of a cleanerless process in which a toner image is formed on an image bearing body by a developing unit, and a toner remaining on the image bearing body is collected by the developing unit, the image forming apparatus comprising:

intermediate transfer means made of laminated layers of plural conductive materials different from each other and having a transfer surface onto which the toner image is transferred from the image bearing body at a specified transfer position; and transfer means for pressing the intermediate transfer means to the image bearing body at the specified transfer position and for applying a specified bias voltage to the intermediate transfer means, wherein with respect to the plural conductive materials of the intermediate transfer means, a layer closer to a side of either one of the toner transferred from the image bearing body and the transfer means, where negative polarity is set, has a higher volume resistance value, and wherein with respect to the conductive materials of two adjacent layers of the intermediate transfer means, when a volume resistance value of the layer closer to the side of either one of the toner transferred from the image bearing body and the transfer means, where the negative polarity is set, is R2, and a volume resistance value of the layer closer to the side where positive polarity is set is R1, the conductive materials satisfy a relation of $R1<R2<R1\times100$.

7. The image forming apparatus according to claim 6, wherein in the intermediate transfer means, at least the layer closest to the side where the toner is transferred is made of an elastic material.

8. The image forming apparatus according to claim 6, wherein the negatively charged toner is transferred from the image bearing body onto the intermediate transfer means, and the transfer means applies a bias voltage in which the polarity of the transfer means becomes positive.

9. The image forming apparatus according to claim 6, further comprising a charger which charges a surface of the image bearing body by a brush and can electrically collect the toner remaining on the image bearing body.

10. The image forming apparatus according to claim 6, wherein the image bearing body and the developing unit are integrally supported as a process unit, and are attachable to and detachable from the image forming apparatus.

* * * * *